United States Patent [19]

Sammann et al.

[11] Patent Number: 4,473,196

[45] Date of Patent: Sep. 25, 1984

[54] HYDRAULICALLY ACTUATED WIRE ROLLER FOR A TRACTOR

[76] Inventors: Ernest F. Sammann, Rte. 4, Box 73, Dimmitt, Tex. 79027; Jess W. Sammann, Rte. 2, Plainview, Tex. 79072

[21] Appl. No.: 413,306

[22] Filed: Aug. 31, 1982

[51] Int. Cl.[3] ..... B65H 17/46; B65H 75/40

[52] U.S. Cl. ..... 242/86.5 R; 242/86.8

[58] Field of Search ..... 242/54 R, 55, 75, 75.2, 242/75.4, 75.53, 76, 86.5, 86.8, 157 R, 158; 226/195; 254/361, 389; 188/65.1

[56] References Cited

U.S. PATENT DOCUMENTS

| | | | |
|---|---|---|---|
| 326,806 | 9/1885 | Stubbe | 242/54 R |
| 443,442 | 12/1890 | Harper | 242/86.8 |
| 669,551 | 3/1901 | Rutherford | 188/65.1 |
| 3,150,842 | 9/1964 | Weber | 242/86.5 R |
| 3,356,341 | 12/1967 | Brown | 242/86.5 R |

*Primary Examiner*—Stuart S. Levy
*Assistant Examiner*—Lloyd D. Doigan
*Attorney, Agent, or Firm*—Marcus L. Bates

[57] ABSTRACT

A motor driven wire roller for attachment to a three point hitch of a farm tractor. The apparatus includes an elongated shaft, having a motor means attached to rotate one end of the shaft, and a wire drum having the central axis thereof attached to a medial part of the shaft so that rotation of the shaft by the motor imparts rotational motion into the wire drum. A wire guide having drag plates associated therewith is included in the apparatus. The entire apparatus is easily assembled to the tractor hitch arm of a three point hitch.

8 Claims, 4 Drawing Figures

HYDRAULICALLY ACTUATED WIRE ROLLER FOR A TRACTOR

BACKGROUND OF THE INVENTION

Most farm type tractors are provided with three point hitches which include two hitch arms. The hitch arms usually are pivoted at one end, and have a free end to which there is attached a lifting attachment that is also a journal means. Various different implements are removably affixed to the journal or lifting means so that one farmhand can back the tractor up to all sorts of different pieces of equipment, raise or lower the three point hitch into engagement with the implement, and thereafter the three point hitch can be raised or adjusted to thereby properly position the implement so that the tractor can pull the implement over the land.

Stringing out wire and retrieving the wire after it has been used is a very cumbersome and dangerous task. The wire, which is sometimes a slick line, and at other times barbed wire, usually comes in quarter mile rolls. Each roll weighs 50–80 pounds. In building fences, for example barbed wire fences, four or five strands of the wire must be strung out along the proposed fence line and subsequently suitably attached under tension to the fence posts. At other times, a barbed wire fence, for one reason or another, must be removed and this sometimes entails retrieving several miles of the barbed wire.

A roll of barbed wire is very heavy and therefore difficult for one man to manipulate. It is especially difficult for one man to support a roll of wire while walking along through undergrowth and parallel to the fence line. Once the strand of barbed wire has been unrolled parallel to the fence post, however, it is not unduly difficult for one person thereafter to attach the wire to the post.

It would therefore be advantageous to have made available a wire roller device by which a substantial length of wire, such as barbed wire, could conveniently be strung out along a fence line by one person working alone; or, alternatively, be retrieved from an existing fence line. Apparatus by which this desirable goal can be achieved is the subject of the present invention.

THE PRIOR ART

U.S. Pat. No. 486,528 "Wire-Reel Carrier", Jacob Phleegar - discloses a reel-carrier for winding and stretching wires. In rewinding wire on a spool, the wire is delivered evenly on the spool by a sliding guide.

U.S. Pat. No. 3,356,341 "Winding & Stretching Attachment for Wire Fences", Jack S. Brown - discloses a power operated winding attachment for tractors having a power hitch and drive takeoff mechanisms. The shaft may also mount a rewinding reel to which the barbed wire may be anchored.

U.S. Pat. No. 679,850 "Line Guide for Reels" - H. Krueger - discloses a fishing reel with an improved line guide. Line guide a and b which sections are formed at their ends with open seats or bearings are adapted to loosely slide upon the spaced rods. The guide section is provided with a long slot through which line 6 runs. The winding guide is moved laterally, so as to cause the line to wind on the spool in layers without overlapping.

U.S. Pat. No. 843,213 "Wire Reel", O. H. Juve - discloses a wire reel adapted for use in handling fence-wire or the like. Means is provided for taking up strands of wire along the line of a fence and disposing of the strands on the reel, and for guiding wire onto the reel.

U.S. Pat. No. 598,138 "Fence Wire Winder", C. E. Cummins

U.S. Pat. No. 1,086,225 "Wire Winder", C. B. Ruby

U.S. Pat. No. 2,688,454 "Wire Reel Support", J. P. Nicolas, Jr.

U.S. Pat. No. 3,107,877 "Wire Winding Apparatus", W. L. Weaklend

U.S. Pat. No. 3,227,393 "Vehicular Wire Winder", D. H. Misegadis

U.S. Pat. No. 3,653,606 "Wire Reeling Machine", Claude Sheets, Jr.

U.S. Pat. No. 3,788,605 "Hydraulic Auto Winch", George Verne Johnson

U.S. Pat. No. 3,934,655 "Hydraulic Post Setting and Wire Dispensing Apparatus"

SUMMARY OF THE INVENTION

A motor driven wire roller for attachment to a three point hitch of a farm type tractor. The wire roller apparatus includes a shaft rotatably connected to a motor means, with there being a wire receiving drum rotatably supported by a medial portion of the shaft. Spaced marginal lengths of the shaft are received by the journals located at the free ends of the tractor hitch arm.

A trailing strut supports the motor means, and the strut includes a forward marginal end portion which is removably secured to one of the tractor hitch arms. The trailing end of the strut is arranged to support a wire guide assembly. The motor means includes a housing aligned at one end of the shaft and fixed to a medial portion of the strut.

The apparatus includes a wire guide arranged to slide along a support assembly. The support assembly includes a lateral arm arranged parallel to the shaft, with one end thereof being affixed to the trailing end of the strut and the other end thereof being adjustably journaled to the rotating shaft.

The wire guide is therefore slidably positioned along the laterally disposed wire guide support assembly, and includes a pair of spring loaded drag plates which close together and drag against the wire. The wire guide further includes a window through which the wire must travel as it is wound or unwound respective to the wire drum.

One person can easily attach the entire wire roller apparatus to a conventional three point hitch of a farm type tractor. The motor means preferably is a hydraulically actuated motor which is conveniently connected into the tractor hydraulic connect box. The fence wire is wound onto the wire drum and extends from the drum, through the pair of spring loaded drag plates, and through the window of the guide means. The guide means and drag plates can be moved laterally along the wire guide support member.

Accordingly, a primary object of the present invention is the provision of a wire roller apparatus by which wire can be rolled or unrolled upon a wire drum.

A further object of the present invention is the provision of a hydraulic wire roller apparatus which can be easily attached to a three point hitch assembly of a conventional farm type tractor, and which strings out and retrieves fence wire in a convenient and improved manner.

Another and still further object of the present invention is the provision of a wire roller apparatus for attachment to a ground type vehicle by which various different type strands of wire can be strung between two geographical locations.

A still further object of the present invention is the provision of an apparatus by which various different lengths of barbed wire can be wound upon a wire drum so that the wire can be strung out along a proposed fence line; and, which enables the wire to be subsequentally wound upon the wire drum.

These and other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
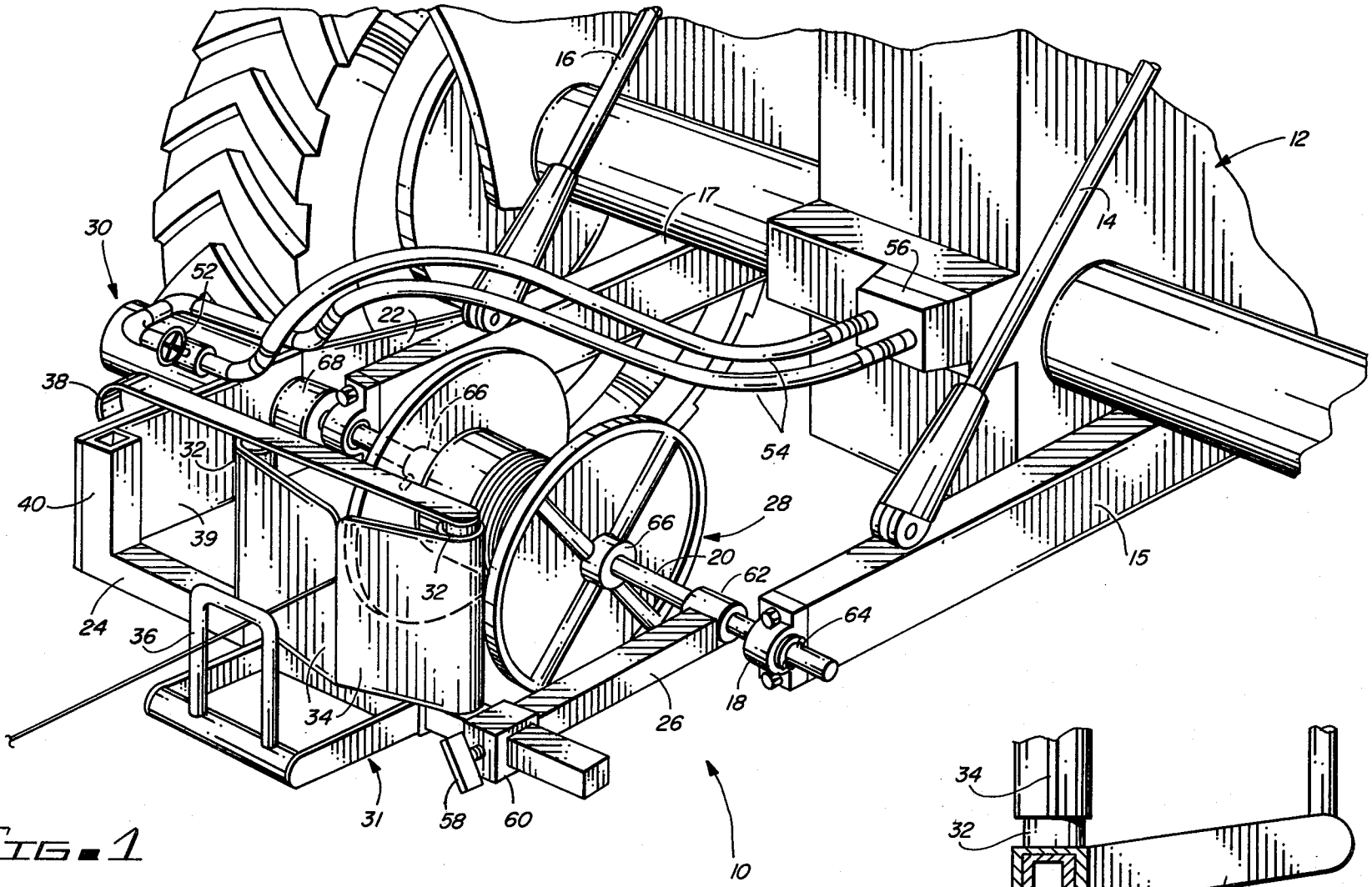
FIG. 1 is a fragmentary, perspective view of a hydraulically actuated wire roller apparatus in combination with a three point hitch of a farm type tractor.
Figure 4:
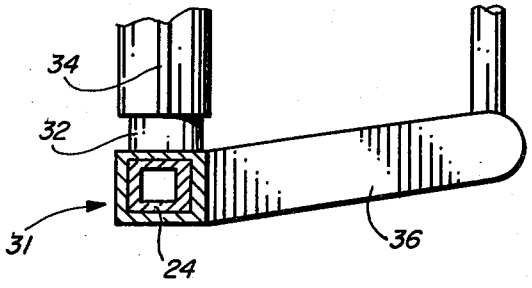
Figure 2:
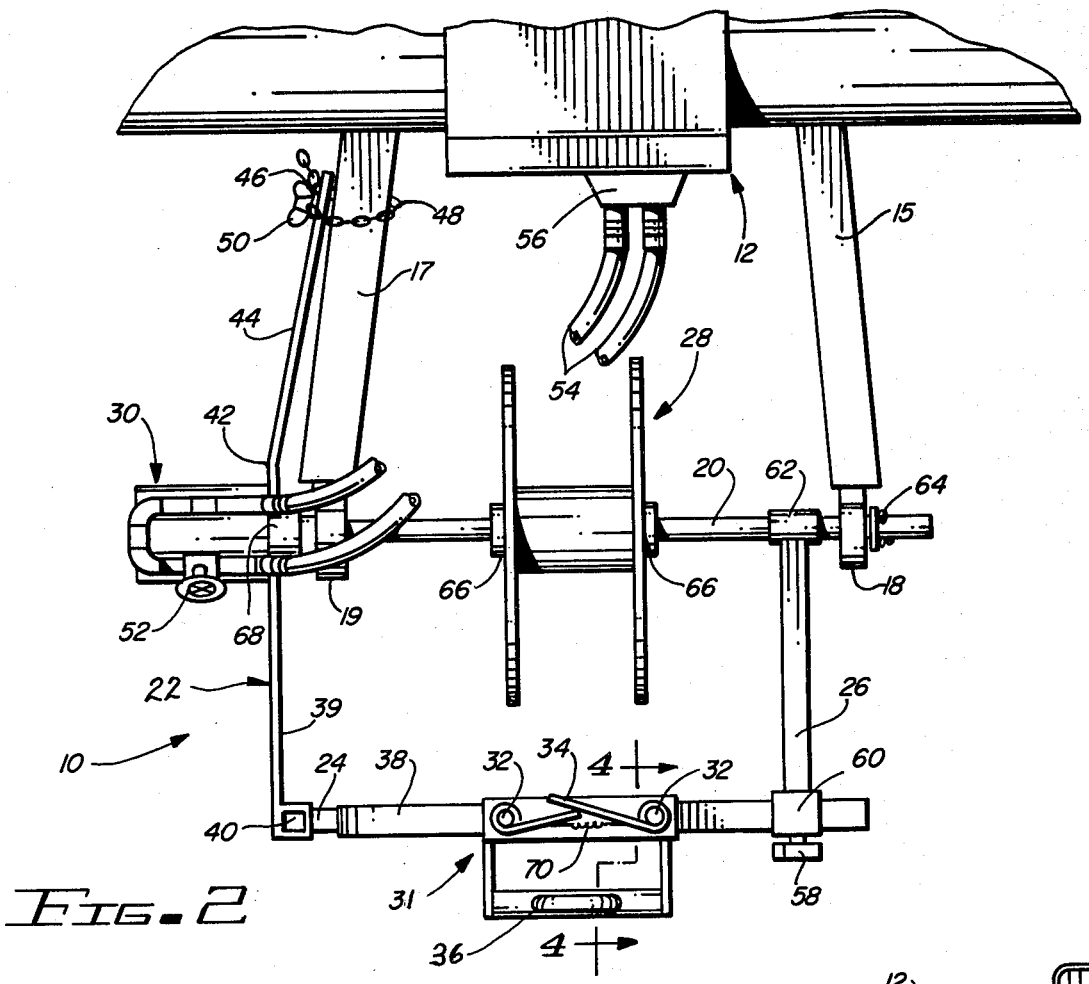
FIG. 2 is a part diagrammatical, part schematical, top plan view of the hydraulically actuated wire roller apparatus disclosed in FIG. 1, with some parts being broken away therefrom.
Figure 3:
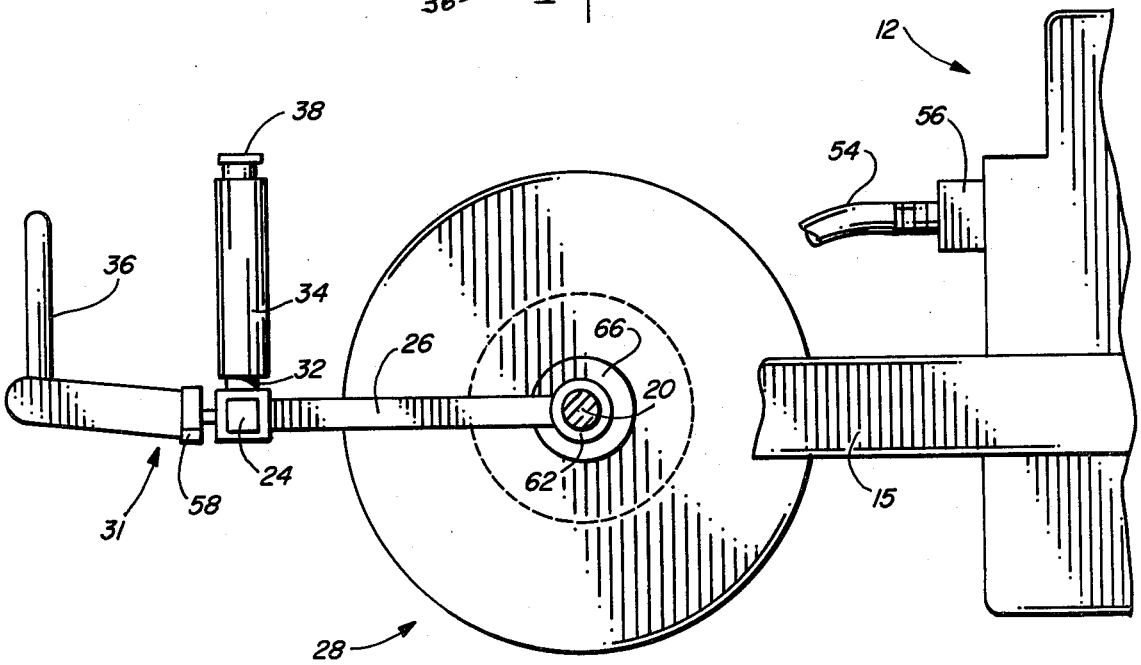
FIG. 3 is a side view of the motor driven wire roller apparatus disclosed in the foregoing figures; and, FIG. 4 is a fragmented, part cross-sectional view taken along line 4—4 of FIG. 2.

In FIG. 1 of the drawings, together with Figures 2–4 thereof, there is disclosed a wire roller apparatus 10 made in accordance with the present invention. The apparatus is removably attached to a tractor 12, such as for example a John Deer model 70 tractor having the illustrated three point hitch associated therewith. The three point hitch includes spaced lifting arms 14 and 16 which are operatively connected to the illustrated trailing hitch arms 15 and 17. The trailing terminal end of the hitch arm is provided with attachment members in the form of journals 18 and 19 by which the three point hitch can be connected to any number of different farm implements, including the present invention, as will be more fully understood as this entire disclosure is more fully digested.

The wire roller apparatus of the present invention includes a drum shaft 20 which is rotatably supported at one end thereof by a support strut 22. A wire guide support assembly 24 is arranged parallel respective to the shaft 20 and laterally respective to a tie bar 26. Drum 28 is of a size to receive a considerable quantity of rolled up slick or barbed wire thereon. Hydraulic motor 30 is of conventional design and is connected for rotating one end of shaft 20. The housing of the motor is fixed respective to the support strut; and, the rotor, or power output shaft of the motor, is preferably directly connected to the terminal end of shaft 20.

The wire guide support assembly includes a pair of gate posts 32 which are more or less parallel to one another and vertically disposed in perpendicular relationship respective to the shaft 20. The gate posts each support a swinging spring loaded drag plate 34 therefrom, with the marginal adjacent vertical edges of the drag plates overlapping one another when pivoted into the folded configuration. A wire guide 36 is disposed rearwardly of the gate post and provides a window through which a strand of wire extends. A control handle 38 is attached to the upper end of the gate posts and extends into an accessible area respective to the tractor driver. The control handle enables the operator to move the sliding assembly 31 along the support member 24.

In FIG. 2 of the drawings, numeral 39 indicates the trailing marginal end of the support strut. A corner post 40 ties the support member 24 into the terminal end of the strut. The strut is bent at 42 to accomodate the forward marginal length 44 thereof continuing at an obtuse angle respective to marginal portion 39. A hangar 46, which includes chain 48 and threaded coupling member 50, removably affixes the forward end of the strut to a medial length of the tractor hitch arm.

A control valve 52 is mounted to the supply hose of the hydraulic motor 30 and controls the flow of hydraulic fluid through flexible pipes 54. Numeral 56 indicates the tractor hydraulic connector box to which quick disconnects are provided so that the terminal ends of flexible piping 54 can easily be connected and disconnected, in a manner known to those skilled in the art.

In FIG. 2 a fastener 58 secures a slidable member 60 respective to the support member 24. Journal 62 rotatably receives shaft 20 in a telescoping manner therethrough and in low friction relationship therewith. A large washer and pin assembly 64 prevents the end 18 of the three point hitch from being unfastened respective to the marginal outer end of the shaft.

Drum hub 66 is fixed respective to shaft 20 so that the drum is rotated therewith. Numeral 68 indicates a bearing hub which journals shaft 20 to the strut 44, and additionally supports the housing of motor 30 respective to the strut so that the motor output shaft can be directly coupled to the end of shaft 20, with the motor housing being affixed in attached relationship respective to the strut. Numeral 70 indicates the springs by which the drag plates 34 are biased towards one another.

In operation, the wire roller apparatus 10 is connected to a three point hitch 12 of a conventional farm tractor by removing tie bar 26 and wire drum 28 from shaft 20, and thereafter inserting the shaft 20 through the support journal 19 of the tractor hitch arm. Chain 48 is looped around the tractor hitch arm 17 and made fast with the threaded fastener means 50, thereby rigidly affixing the strut 22 to one of the tractor hitch arms. The drum is telescoped over the shaft 20 and fastened at 66, the tie bar 26 is slidably positioned about shaft 20 and member 24, after which fastener 58 is made up. Next the tractor hitch arm 15 is telescoped over the marginal remaining end of the shaft 20, and the washer and pin at 64 are made up. The entire apparatus can now be elevated as may be required by the three point hitch. The hydraulic flexible hoses 54 are plugged into the tractor hydraulic connector box. Valve 52 is adjusted to provide the desired torque on shaft 20 so that the wire received about the drum is placed under any selected tension desired for attaining any particular tautness.

In building fences, it is convenient to wind four or five rolls of barbed wire onto the drum to obviate the laborious manual handling of the individual rolls of barbed wire out in the field. This enables the rolled up wire to be transported to the fence line by the tractor, where one end of the wire is tied to the first fence post, and the tractor is next driven down the fence row with the hydraulic motor exerting sufficient torque on the shaft to place the wire under sufficient tension to prevent the wire from becoming entangled in weeds, brush and small trees which may lie along the fence line.

The tractor preferably is parked parallel to the fence line, with sufficient tension exerted on the wire by the motor driven wire drum to enable one man to walk back down the fence line, hammering the fasteners which hold the wire into the post.

When it is desired to roll used wire onto the drum, such as removing an old fence, the end of the wire is placed through the wire guide 36 and drag plates 32, and fastened to the drum surface. With the tractor parked in neutral gear, and the engine running at idle speed, the operator begins to slowly manipulate valve 52 with his left hand until the drum turns at the desired speed. With his right hand on handle 38, he can move the entire sliding assembly 31 longitudinally back and forth on member 24, keeping the wire level as it builds up on the drum. The operator is positioned at a safe distance from the revolving drum and incoming wire, and controls the power being applied to the drum with the by-pass valve 52, making this invention much safer than machines with positive power supplies such as gear drives, PTO shafts, chain drives, and the like.

The drag plates 34 are spring loaded and can be jointly pivoted into a position towards the drum when wire is being rolled thereon, and pivoted away from the drum when the wire is being pulled from the drum. The free edge of the drag plates ride against the wire and influence the wire to lie down in proper rows onto the drum surface. The drag plates also form a barrier between nearby persons and the wire, which is especially important when the wire is under undue tension.

The wire guide 36 guides the wire centrally through the spaced drag plates and onto the drum. The entire sliding assembly 31 is slidably received on member 24 and can be moved longitudinally thereon by handle 38. The operator stands beside the apparatus and anytime he notes that the wire is not lying down in uniform rows across the surface of the drum, he can grasp handle 38, and reposition the sliding assembly.

It is considered within the comprehension of the present invention to employ an electric motor at 30 by connecting the motor into the electrical supply of the tractor. A hydraulic motor is preferred because an infinite selection of constant tension values is available by merely adjusting valve 52. Moreover, a hydraulic motor can be stalled without harm thereto, whereas an electric motor must be specially designed to be operated under extremely slow or stalled conditions.

The present invention provides a means by which one person can build or remove a barbed wire fence. The present invention also finds utility in stringing slick line, such as telephone cable, electrical wire, and insulated burial cable.

The present invention in combination with a three point hitch associated with a farm tractor provides a unique and very useful tool for the farmer who cannot afford the necessary man power required for building fences and the like.

I claim:

1. A motor driven wire roller apparatus for attachment to a three point hitch of a farm tractor, comprising:

an elongated shaft, a motor means attached to rotate said shaft, a wire receiving drum attached along the central axis thereof to a medial part of said shaft, means by which the opposed marginal ends of said shaft can be journaled in a removable manner to a three point hitch;

and guide means by which wire is guided toward said wire drum; a strut having a trailing end and a fixed end, means by which said fixed end can be removably affixed to a medial part of one hitch arm of a three point hitch of a tractor, with said trailing end of said strut extending rearwardly of a tractor to which it is mounted; said motor means includes a housing mounted to said strut;

a tie bar having one end journaled to a medial length of said shaft with the other end extending rearwardly from said shaft; said guide means is supported by the trailing end of said strut and the other end of said tie bar;

said strut and drum are separated from one another by one lifting arm, said tie bar is located between the drum and the second lifting arm, so that the motor means, strut, and shaft can be slidably received by one lifting arm; while the drum, tie bar, and second lifting arm slidably receives the shaft.

2. The wire roller of claim 1 wherein said guide means includes drag plates; said drag plates are pivotally attached to a pair of parallel upstanding gate posts so that the drag plates can be pivoted towards and away from one another and into sliding engagement with a wire which may pass therethrough.

3. The wire roller of claim 1 wherein said motor means is hydraulically actuated and includes flow lines which can be connected to a tractor hydraulic fluid pump; and, means controlling the motor torque including a valve means connected to control the flow of power fluid to and from the motor means.

4. In a farm tractor having a three point hitch, including a pair of tractor lift arms having one end pivoted to the tractor with the opposed ends terminating in journal means at a free end thereof; the combination with said hitch of a motor driven wire roller assembly by which wire can be rolled up and strung out, comprising:

an elongated shaft received through the journals located at the free end of the lift arms; a support strut assembly having one end thereof attached to a marginal length of one of the tractor lift arms thereby leaving a marginal length of the strut trailing therebehind;

a rotatable shaft extending through the journals located at the end of the tractor lift arms; a motor means supported by said support strut; said motor means has a power output shaft attached to rotate said shaft; a tie bar having one end journaled to said shaft with the other end extending therefrom;

a wire drum affixed to rotate with said shaft; a wire guide assembly spaced from said drum and movable parallel to said shaft; said wire guide assembly is attached to a trailing end of said strut and the other end of said tie bar;

said strut and drum are separated from one another by one lifting arm, the journaled end of said tie bar is located between the drum and a lifting arm.

5. The combination of claim 4 wherein said wire guide means includes a support member extending from the end of said strut and from the end of said tie bar;

said wire guide means is slidably received on the wire guide support member so that the wire guide support member can be moved laterally respective to any wire passing therethrough and onto the drum.

6. The combination of claim 5 wherein said wire guide means include drag plates; said drag plates are pivotally attached to a pair of parallel upstanding gate posts so that the drag plates can be pivoted towards and away from one another and into sliding engagement with a wire which may pass therethrough.

7. In a vehicle of the type having a three point hitch, wherein said hitch includes a pair of parallel lifting arms journaled to the vehicle and which terminate in journal means at a free end thereof; the combination with said hitch of a motor driven wire roller assembly by which wire can be rolled up and strung out, comprising:

an elongated shaft having opposed marginal ends removably received through the journals located at the free end of the lifting arms; a support strut assembly having a marginal end portion thereof attached to a medial length of one of the lifting arms and another marginal length trailing therebehind;

a motor means affixed to said support strut; said motor means has a power output shaft attached to rotate said shaft; a tie bar having a journaled end and an opposed end;

a wire receiving drum affixed to rotate with said shaft; a wire guide means spaced from said drum and movable parallel to said shaft; said wire guide means being attached to the trailing end of said strut and to said opposed end of said tie bar; said wire guide means includes a support member extending from the end of said trailing end of said strut and from the opposed end of said tie bar;

said wire guide means is slidably received on said wire guide support member so that the wire guide support can be moved laterally respective to any wire passing therethrough and onto the drum;

said drum is located between said tie bar and one of the lifting arms; said journalled end of said tie bar is journalled on the shaft between the other lifting arm and said drum.

8. The combination of claim 7 wherein said wire guide means includes drag plates, said drag plates are pivotally attached to a pair of parallel upstanding gate posts so that the drag plates can be pivoted towards and away from one another and into engagement with a wire which may pass therethrough.

* * * * *